US009801420B2

(12) United States Patent
Hays et al.

(10) Patent No.: US 9,801,420 B2
(45) Date of Patent: Oct. 31, 2017

(54) ABDOMINAL-RESTRAINT GARMENT AND METHODS OF ASSEMBLING THE SAME

(71) Applicant: Spanx, Inc., Atlanta, GA (US)

(72) Inventors: Tosha L. Hays, Atlanta, GA (US); Laurie A. Goldman, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 517 days.

(21) Appl. No.: 13/834,506

(22) Filed: Mar. 15, 2013

(65) Prior Publication Data

US 2014/0273741 A1 Sep. 18, 2014

(51) Int. Cl.
*A41D 1/06* (2006.01)
*A41D 27/02* (2006.01)

(52) U.S. Cl.
CPC ..... *A41D 1/06* (2013.01); *A41D 27/02* (2013.01); *A41D 2400/38* (2013.01)

(58) Field of Classification Search
CPC ..... A41D 1/06; A41D 1/062; A41D 13/02; A41D 1/14; A41D 27/02; A41D 1/20; A41C 1/08; A41C 1/006; A41C 1/10
USPC ..... 450/95
See application file for complete search history.

(56) References Cited

U.S. PATENT DOCUMENTS 541,334 A * 6/1895 Roschi ..... A41D 1/06 2/227
2,410,226 A * 10/1946 Martin ..... 2/227
3,068,871 A * 12/1962 Rapp ..... A41D 1/06 450/95
3,127,896 A 4/1964 Puliafico
3,185,158 A * 5/1965 Gattuso ..... A41F 9/025 2/236

(Continued)

FOREIGN PATENT DOCUMENTS

| | | |
|---|---|---|
| EP | 2401930 | 1/2012 |
| EP | 20110165865 | 1/2012 |
| GB | 2356552 | 5/2001 |

OTHER PUBLICATIONS

U.S. Appl. No. 13/835,175, filed Mar. 15, 2013, and the prosecution history thereof.

(Continued)

*Primary Examiner* — Gloria Hale
*Assistant Examiner* — Brieanna Szafran
(74) *Attorney, Agent, or Firm* — Meunier Carlin & Curfman LLC

(57) ABSTRACT

Disclosed herein are abdominal-restraint garments comprising an outer garment layer and an inner abdominal-restraint layer. The inner abdominal-restraint layer can be attached to the outer garment layer. In some embodiments, a first lateral edge and a second lateral edge of the inner abdominal-restraint layer are attached to an inner side of the outer garment layer. The top of the inner abdominal-restraint layer can be configured to be even with the front rise of the outer garment layer or extend above the front rise of the outer garment layer. The inner abdominal-restraint layer can be configured to extend across a garment-wearer's abdominal region. In some embodiments, the abdominal-restraint garment is a pair of pants, jeans, a pair of shorts, a skirt, leggings, or tights. Also disclosed herein are methods of assembling the abdominal-restraint garments disclosed herein.

22 Claims, 3 Drawing Sheets

(56) References Cited

U.S. PATENT DOCUMENTS 3,214,770 A * 11/1965 Smith ..... A41D 1/08 2/227
3,234,947 A 2/1966 Bergstein
3,246,342 A 4/1966 Pagano
3,457,926 A * 7/1969 Bacon et al. ..... 450/95
3,533,412 A * 10/1970 Bayer ..... A41C 1/02 450/104
3,710,801 A * 1/1973 Bienenfeld ..... A41C 1/08 450/123
3,751,731 A * 8/1973 Bennett ..... A41D 1/06 2/227
3,859,667 A * 1/1975 Roy ..... A41D 1/06 2/212
3,965,943 A 6/1976 Goff et al.
4,069,513 A 1/1978 Shiller et al.
5,010,595 A * 4/1991 Stradley ..... A41D 1/06 2/227
5,060,315 A * 10/1991 Ewing ..... A41B 9/005 2/109
5,127,108 A * 7/1992 Weiss ..... A41D 1/06 2/220
5,359,732 A 11/1994 Waldman et al.
5,535,451 A 7/1996 Tassone et al.
5,675,842 A * 10/1997 Schaefer ..... A41F 9/02 2/221
5,888,118 A * 3/1999 Kishi ..... A41C 1/003 2/243.1
5,994,612 A 11/1999 Watkins
6,035,448 A 3/2000 Thomson
6,138,282 A 10/2000 Follese
6,205,591 B1 3/2001 Wheeler et al.
6,311,333 B1 11/2001 Batra
6,367,086 B1 4/2002 Woodard
6,543,062 B1 4/2003 Amsel et al.
6,620,026 B1 9/2003 Guilani et al.
6,922,849 B1 * 8/2005 Fedrick ..... A41D 1/062 2/227
D588,782 S 3/2009 Rudes
7,574,752 B1 * 8/2009 Walters ..... A41D 1/062 2/227
7,596,816 B1 * 10/2009 Henry et al. ..... 2/227
D644,412 S * 9/2011 Reuther ..... D2/714
8,418,268 B2 4/2013 Waldman et al.
D689,260 S * 9/2013 Barnes ..... D2/742
8,607,364 B2 * 12/2013 Barski ..... A41B 13/06 2/111
8,813,266 B1 * 8/2014 Green ..... A41F 7/00 2/229
8,959,665 B1 2/2015 Garner et al.
8,990,970 B2 * 3/2015 Lee ..... A41B 9/14 2/307
9,044,051 B1 6/2015 Rydman et al.
9,326,552 B2 * 5/2016 Hays ..... A41C 1/08
2002/0133865 A1 * 9/2002 Neman ..... A41B 9/08 2/170
2004/0163159 A1 * 8/2004 Edwards et al. ..... 2/338
2005/0268379 A1 * 12/2005 MacGeorge ..... A41F 9/02 2/400
2006/0010571 A1 * 1/2006 Oakley ..... A41D 1/062 2/227
2007/0118954 A1 5/2007 Lee
2007/0136930 A1 * 6/2007 Dipietro ..... 2/227
2007/0266478 A1 11/2007 Girod
2008/0189834 A1 * 8/2008 Leung ..... A41B 9/08 2/406
2008/0295225 A1 * 12/2008 Hendrickson et al. ..... 2/237
2009/0031470 A1 * 2/2009 Ishikawa et al. ..... 2/69
2009/0083894 A1 * 4/2009 Causey-Gabbe ..... A41B 9/08 2/78.1
2009/0254017 A1 10/2009 Dumpson et al.
2010/0136882 A1 * 6/2010 Malish ..... 450/11
2010/0192283 A1 8/2010 Kim
2010/0192284 A1 8/2010 Simon
2010/0275339 A1 11/2010 Huc
2010/0325766 A1 * 12/2010 Mackintosh ..... A41D 13/00 2/22
2011/0004976 A1 * 1/2011 MacGillivray ..... 2/221
2011/0016602 A1 1/2011 Berns et al.
2011/0059678 A1 * 3/2011 Agassi et al. ..... 450/154
2011/0061147 A1 3/2011 Welfeld
2011/0099677 A1 5/2011 Mamiye et al.
2011/0131705 A1 * 6/2011 Waldman et al. ..... 2/221
2011/0179556 A1 * 7/2011 Partovi ..... A41F 7/00 2/406
2011/0209262 A1 9/2011 Waldman et al.
2012/0000007 A1 * 1/2012 Hansen ..... A41D 1/06 2/234
2012/0005797 A1 * 1/2012 Cotsoglou ..... A41D 13/05 2/16
2012/0060253 A1 3/2012 Bertin et al.
2012/0144548 A1 6/2012 Quaranta
2013/0019370 A1 1/2013 Dweck et al.
2013/0095730 A1 * 4/2013 Jensen ..... A41C 1/003 450/95
2013/0145516 A1 6/2013 Zielinski
2014/0165265 A1 6/2014 Tulin et al.
2014/0273743 A1 9/2014 Hays et al.
2014/0310854 A1 10/2014 Kianmahd
2014/0331385 A1 11/2014 Okies et al.
2015/0164151 A1 * 6/2015 James ..... A41D 1/06 450/95
2015/0173424 A1 6/2015 Carney
2016/0120246 A1 * 5/2016 Boyle ..... A41D 1/06 2/227
2017/0042257 A1 * 2/2017 Carrer ..... A41D 1/06

OTHER PUBLICATIONS

U.S. Appl. No. 14/533,538, filed Nov. 5, 2014 and the prosecution history thereof.
U.S. Appl. No. 13/835,175, filed Mar. 15, 2014 and the prosecution history Thereof.
ShapeFX Jeans, images of which are submitted herewith.

* cited by examiner

ABDOMINAL-RESTRAINT GARMENT AND METHODS OF ASSEMBLING THE SAME

FIELD OF THE DISCLOSURE

The present disclosure relates to abdominal restraint garments comprising an outer garment layer and an inner abdominal-restraint layer. The present disclosure also relates to methods of assembling the abdominal restraint garments disclosed herein.

BACKGROUND

Many people face recurring problems with abdominal fat protruding over and around their clothing, especially with lower-body garments that cinch at the waist. Designers have produced a variety of garments and undergarments designed to help conceal undesirable bulges of abdominal fat caused by garments that cinch at the waist (known as the "muffin top" effect). However, a continuing need exists for improved garments and undergarments that can restrain, smooth, and conceal undesirable bulges of abdominal fat.

SUMMARY OF THE DISCLOSURE

Disclosed herein are abdominal-restraint garments comprising an outer garment layer and an inner abdominal-restraint layer. The outer garment layer can comprise a front rise, a first side seam, a second side seam, an inseam, a crotch seam, an anterior portion, a posterior portion, a first back pocket (having a lateral seam and a medial seam), a second back pocket (having a lateral seam and a medial seam), or combinations thereof. The inner abdominal-restraint layer can have a top, a first lateral edge, a second lateral edge, a bottom, or combinations thereof.

The inner abdominal-restraint layer can be attached to the outer garment layer (for instance, by sewing, adhering, zipping, buttoning, snapping, heat sealing, welding, gluing, bonding, laser cutting, and combinations thereof). In some embodiments, the first lateral edge and the second lateral edge of the inner abdominal-restraint layer are attached to an inner side of the outer garment layer. In some embodiments, the first lateral edge of the inner abdominal-restraint layer is attached to the inner side of the first side seam of the outer garment layer, and the second lateral edge of the inner abdominal-restraint layer is attached to inner side of the second side seam of the outer garment layer. In some embodiments, the first lateral edge of the inner abdominal-restraint layer is attached on or adjacent to the inner side of the lateral seam of the first back pocket of the posterior portion, and the second lateral edge of the inner abdominal-restraint layer is attached on or adjacent to the inner side of the lateral seam of the second back pocket of the posterior portion. In some embodiments, the bottom side of the inner abdominal-restraint layer is attached to the inner side of the inseam of the outer garment layer, to the inner side of the crotch seam of the outer garment layer, or to a combination thereof.

The top of the inner abdominal-restraint layer can be configured to be even with the front rise of the outer garment layer or extend above the front rise of the outer garment layer by, for instance, 0.25 inches to 12 inches. The inner abdominal-restraint layer can be configured to extend across a garment-wearer's abdominal region.

In some embodiments, the abdominal-restraint garment is a pair of pants, jeans, a pair of shorts, a skirt, leggings, or tights. In some embodiments, the inner abdominal-restraint layer has a higher elasticity than the outer garment layer. The outer garment layer can comprise denim, twill, woven fabric, or knit fabric. The inner abdominal-restraint layer can comprise spandex or a spandex blend.

Also disclosed herein are methods of assembling abdominal-restraint garments, comprising attaching a first lateral edge of an inner abdominal-restraint layer to an inner side of an outer garment layer, positioning the inner abdominal-restraint layer over an abdominal portion of the outer garment layer, positioning a top of the inner abdominal-restraint layer such that it is even with a front rise of the outer garment layer or such that it extends above a front rise of the outer garment layer, and attaching a second lateral edge of the inner abdominal-restraint layer to the inner side of the outer garment layer.

In some embodiments, the methods comprise attaching the first lateral edge of the inner abdominal-restraint layer to an inner side of a lateral seam of a first back pocket of a posterior portion of the outer garment layer, and attaching the second lateral edge of the inner abdominal-restraint layer to an inner side of a lateral seam of a second back pocket of the posterior portion of the outer garment layer. In some embodiments, positioning the inner abdominal restraint layer includes elastically extending the inner abdominal restraint layer over the abdominal portion. The methods disclosed herein can further comprise attaching a bottom side of the inner abdominal-restraint layer to an inner side of an inseam of the outer garment layer.

The description below sets forth details of one or more embodiments of the present disclosure. Other features, objects, and advantages will be apparent from the description and from the claims.

DETAILED DESCRIPTION

Disclosed herein are abdominal-restraint garments comprising an inner abdominal-restraint layer attached to an outer garment layer, and methods of assembling the same.

Figure 1:
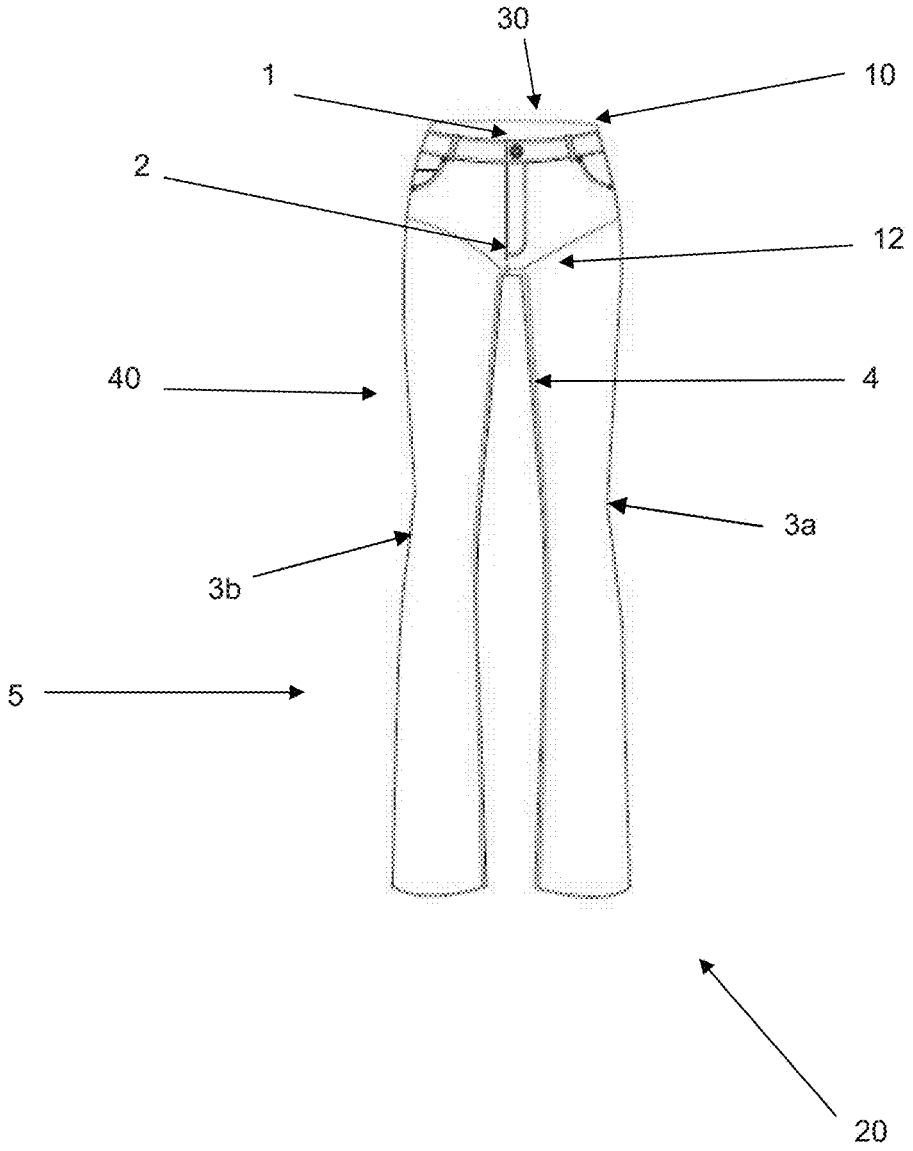
FIG. 1 depicts a front-view of one embodiment of an abdominal-restraint garment disclosed herein.
Figure 2:
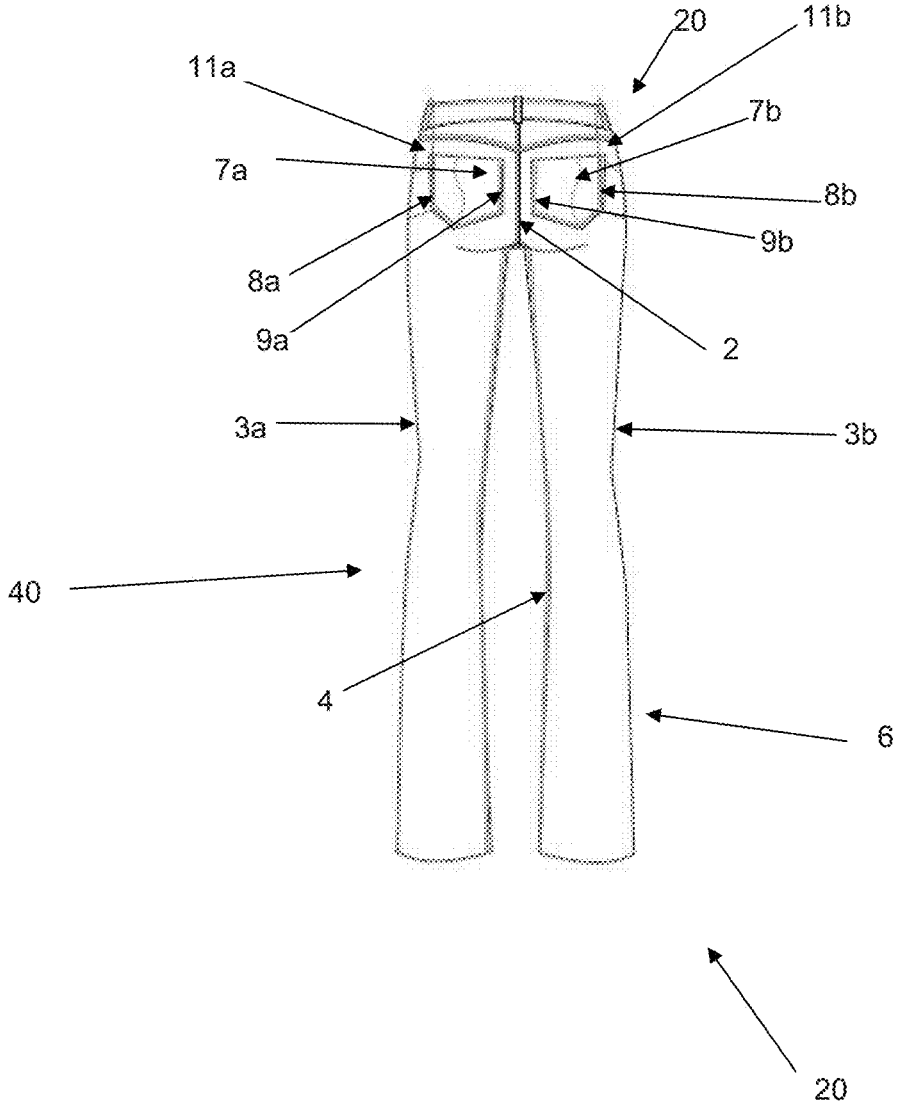
FIG. 2 depicts a back-view of one embodiment of an abdominal-restraint garment disclosed herein.
Figure 3:
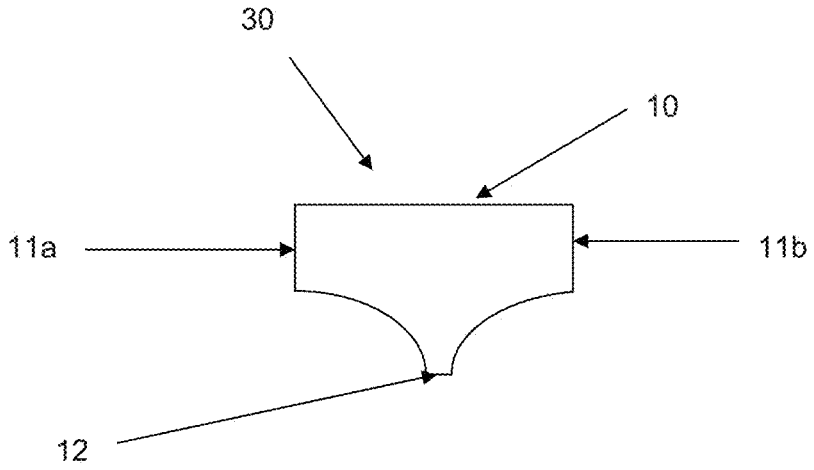
FIG. 3 depicts one embodiment of an inner abdominal-restraint layer disclosed herein.

The abdominal-restraint garments disclosed herein can be any lower-body garment wherein restraining, smoothing, or concealing bulges of abdominal fat caused by cinching the garment wearer's waist could be desirable. In some embodiments, the abdominal-restraint garment is a pair of pants, jeans, a pair of shorts, a skirt, leggings, or tights. FIGS. 1-3 depict exemplary embodiments of the abdominal-restraint garments described herein.

As depicted in FIGS. 1 and 2, the abdominal-restraint garments 20 disclosed herein comprise an outer garment layer 40 and an inner abdominal-restraint layer 30. The lateral edges 11*a/b* of the inner abdominal-restraint layer 30 attach to the inside of the outer garment layer 40, forming a convenient one-piece abdominal-restraint garment 20 that reduces or eliminates the undesirable muffin-top effect to the garment wearer without the need for wearing a separate shape-wear piece (e.g., pantyhose, control-top underwear, etc.) and outer wear piece (e.g., pants, jeans, skirts, leggings, etc.). Additionally, the convenient one-piece abdominal-restraint garment 20 can be easier for the garment wearer to put on and take off than separate shape-wear pieces and outer-wear pieces (e.g., while dressing for the day or during bathroom breaks during the day). The top of the inner abdominal-restraint layer 30 is even with or projects above the front rise 1 of the outer garment layer 40 to restrain, conceal, or smooth undesirable bulges of abdominal fat and reduce or eliminate the muffin-top effect. The top of the inner abdominal-restraint layer 30 can be configured to extend above the front rise 1 of the outer garment layer 40 by various amounts, depending on the degree of abdominal coverage desired.

The outer garment layer can comprise any fabric known in the art for use in a lower-body garment. The outer garment layer can comprise a natural fabric, a synthetic fabric, or a blended fabric. In some embodiments, the outer garment layer comprises denim, twill, woven fabric, or knit fabric. Exemplary outer garment layers can comprise, for example, cotton, leather, faux leather, suede, faux suede, polyester, denim, twill, tweed, wood pulp, bamboo, corn fibers, leaves, moleskin, barkcloth, barathea, silk, rayon, nylon, wool, batiste, Bedford cord, bengaline, acetate, berber fleece, burlap, flannel, canvas, lace, goat skin, satin, sateen, charmeuse, cheesecloth, corduroy, linen, crinoline, velvet, spandex, animal pelts, faux animal pelts, jersey, terry cloth, velour, velveteen, nonwoven fabrics such as felt, and blends thereof. The outer garment layer can comprise any number of layers of fabric. In some embodiments, the outer garment layer comprises one layer. In some embodiments, the outer garment layer comprises two layers. The outer garment layer can comprise, for instance, a bonded fabric comprising two or more layers joined together with, for instance, an adhesive, resin, foam, fusible membrane, or sewn together. As shown in FIGS. 1 and 2, the outer garment layer 40 can comprise a front rise 1, a first side seam 3*a*, a second side seam 3*b*, an inseam 4, a crotch seam 2, an anterior portion 5, a posterior portion 6, a first back pocket 7*a* (having a first lateral seam 8*a* and a first medial seam 9*a*), a second back pocket 7*b* (having a second lateral seam 8*b* and a second medial seam 9*b*), or combinations thereof. In some embodiments, the outer garment layer has back pockets. In some embodiments, the outer garment layer does not have back pockets.

The inner abdominal-restraint layer can be made of any fabric capable of restraining, smoothing, and/or concealing undesirable bulges of abdominal fat. In some embodiments, the inner abdominal-restraint layer has a higher elasticity than the outer garment layer. The inner abdominal-restraint layer can comprise a natural fabric, a synthetic fabric, or a blend thereof. In some embodiments, the inner abdominal-restraint layer comprises spandex. In some embodiments, the inner abdominal-restraint layer comprises a spandex blend. In some embodiments, the inner abdominal-restraint layer comprises a polyester/spandex blend. In some embodiments, the inner abdominal-restraint layer comprises nylon. In some embodiments, the inner abdominal-restraint layer comprises 75% or less of spandex (e.g., 70% or less, 60% or less, 50% or less, 40% or less, 35% or less, 30% or less, 25% or less, 20% or less, 15% or less, or 10% or less). In some embodiments, the inner abdominal-restraint layer comprises 5% or greater of spandex (e.g., 10% or greater, 15% or greater, 20% or greater, 25% or greater, 30% or greater, 35% or greater, 40% or greater, 50% or greater, or 60% or greater). In some embodiments, the inner abdominal-restraint layer comprises 90% or less of nylon (e.g., 85% or less, 80% or less, 75% or less, 70% or less, 60% or less, 50% or less, 40% or less, 35% or less, 30% or less, 25% or less, 20% or less, 15% or less, or 10% or less). In some embodiments, the inner abdominal-restraint layer comprises 5% or greater of nylon (e.g., 10% or greater, 15% or greater, 20% or greater, 25% or greater, 30% or greater, 35% or greater, 40% or greater, 50% or greater, 60% or greater, 65% or greater, 70% or greater, 75% or greater, 80% or greater, or 85% or greater). In some embodiments, the inner abdominal-restraint layer comprises 40% or less of polyester (e.g., 30% or less, 25% or less, 20% or less, 15% or less, or 10% or less). In some embodiments, the inner abdominal-restraint layer comprises 5% or greater of polyester (e.g., 10% or greater, 15% or greater, 20% or greater, 25% or greater, 30% or greater, or 35% or greater). In some embodiments, the inner abdominal-restraint layer comprises a spandex/nylon blend. In some embodiments, the inner abdominal-restraint layer comprises modal, rayon, and spandex. In some embodiments, the inner abdominal-restraint layer comprises cotton. In some embodiments, the inner abdominal-restraint layer comprises a cotton blend. In some embodiments, the inner abdominal-restraint layer comprises cotton. The inner abdominal-restraint layer can be chosen from any of the fabrics described above for the outer garment layer. The inner abdominal-restraint layer can be made, for instance, by circular knitting, warp knitting, or any weaving or knitting technique known in the art. In some embodiments, the inner-abdominal restraint layer has varied properties. For instance, the inner abdominal-restraint layer can have a gradient of elasticity, horizontally or vertically across the inner abdominal-restraint layer. In some embodiments, the inner abdominal-restraint layer comprises a denser fabric at the bottom. In some embodiments, the inner abdominal-restraint layer comprises a less dense fabric at the top.

The inner abdominal-restraint layer can comprise any number of layers of fabric. In some embodiments, the inner abdominal-restraint layer comprises one layer. In some embodiments, the inner abdominal-restraint layer comprises two layers. The inner abdominal-restraint layer can comprise, for instance, a bonded fabric comprising two or more layers joined together with, for instance, an adhesive, resin, foam, or fusible membrane. In some embodiments, the inner abdominal-restraint layer comprises a double layer with sandwiched elastic at the waist. In some embodiments, the inner abdominal-restraint layer comprises a single layer with no elastic. As depicted in FIG. 3, the inner abdominal-restraint layer 30 can have a top 10, a first lateral edge 11*a*, a second lateral edge 11*b*, a bottom 12, or combinations thereof.

The inner abdominal-restraint layer can be attached to the outer garment layer by any means capable of attaching garment layers together. In some embodiments, the outer garment layer is attached by sewing, adhering, zipping, buttoning, snapping, heat sealing, welding, gluing, bonding, laser cutting, and combinations thereof. In some embodiments, the first lateral edge and the second lateral edge of the inner abdominal-restraint layer are attached to an inner side of the outer garment layer. In some embodiments, the first lateral edge of the inner abdominal-restraint layer is attached to the inner side of the first side seam of the outer garment layer, and the second lateral edge of the inner abdominal-restraint layer is attached to inner side of the second side seam of the outer garment layer. In some embodiments, as depicted in FIG. 2, the first lateral edge 11*a* of the inner abdominal-restraint layer 30 is attached on or adjacent to the inner side of the lateral seam 8*a* of the first back pocket 7*a* of the posterior portion 6 of the outer garment layer 40, and the second lateral edge 11*b* of the inner abdominal-restraint layer 30 is attached on or adjacent to the inner side of the lateral seam 8*b* of the second back pocket 7*b* of the posterior portion 6 of the outer garment layer 40.

The bottom of the inner abdominal-restraint garment can be attached to the outer garment layer or not attached to the outer garment layer. In some embodiments, the bottom 12 of the inner abdominal-restraint layer 30 is attached to the inner side of the inseam 4 of the outer garment layer 40, to the inner side of the crotch seam 2 of the outer garment layer 40, or to a combination thereof.

The top of the inner abdominal-restraint layer can be configured to be even with the front rise of the outer garment layer or extend above the front rise of the outer garment layer by, for instance, 0.25 inches to 12 inches (e.g., 0.5 inches, 1 inch, 1.5 inches, 2 inches, 2.5 inches, 3 inches, 3.5 inches, 4 inches, 4.5 inches, 5 inches, 5.5 inches, 6 inches, 6.5 inches, 7 inches, 7.5 inches, 8 inches, 8.5 inches, 9 inches, 9.5 inches, 10 inches, 10.5 inches, 11 inches, or 11.5 inches). The inner abdominal-restraint layer can be configured to extend across a garment-wearer's abdominal region to a greater or lesser amount, depending on the amount of abdominal coverage desired by the garment wearer. The higher that the top of the inner abdominal-restraint layer extends above the front rise of the outer garment layer, the more of the garment-wearer's abdominal region can be covered by the inner abdominal-restraint layer. And in embodiments where more of the garment-wearer's abdominal region can be covered by the inner abdominal-restraint layer, greater smoothing, restraining, and/or concealing of undesirable bulges of abdominal fat can be achieved. A higher top of the inner-abdominal restraint layer can provide a smoother transition from the restrained abdominal region to the unrestrained regions adjacent to the abdominal region, reducing and/or eliminating the muffin-top effect. In some embodiments, the inner abdominal-restraint layer extends above the front rise of the outer garment layer, over the entire front abdominal region, and up across at least some of the ribs.

When less restraint, smoothing, and/or concealing of undesirable bulges of abdominal fat is necessary, the top of the inner abdominal-restraint layer can be even with the front-rise of the outer garment layer or extend above the front-rise of the outer garment layer by a lesser amount. In embodiments having the inner abdominal-restraint layer even with the front-rise of the outer garment layer or extending above the front-rise of the outer garment layer by a lesser amount, the lower abdominal region can be restrained while smoothing the transition from the restrained lower abdominal region to the unrestrained upper abdominal region. Further, in embodiments having the inner abdominal-restraint layer even with the front-rise of the outer garment layer or extending above the front-rise of the outer garment layer by a lesser amount, a decreased amount of fabric is necessary to make the inner abdominal-restraint layer, potentially leading to material savings and thus cost savings to the manufacturer. Embodiments having less abdominal coverage can also preserve less of a garment-wearer's body heat.

In some embodiments, the inner abdominal-restraint layer wraps around the garment wearer's sides to smooth, restrain, and/or conceal undesirable bulges of abdominal fat on the sides of the body. The extent to which the inner abdominal-restraint layer wraps around the garment-wearer's sides can depend, at least in part, on where the inner abdominal restraint layer is attached to the outer garment layer (e.g., at the side seams of the outer garment layer, at the lateral seams of the back pockets of the outer garment layer, etc.). The lateral edges of the inner abdominal-restraint layer are the outside edges of the inner abdominal-restraint layer, as depicted in FIG. 3. The lateral edges in FIG. 3 are straight, but can be designed in any shape that allows them to be securely attached to the outer garment layer.

Attaching the lateral edges of the inner-abdominal restraint layer further back on the outer garment layer (e.g., on the back pockets instead of the side seams) can allow the inner abdominal-restraint layer to wrap further around the garment-wearer's body. The further the inner abdominal-restraint layer wraps around garment-wearer's body, the greater the degree of restraint, control, and/or smoothing of the abdominal region and adjacent side regions. Thus, attaching the inner abdominal-restraint layer to, for instance, the lateral seams of the back pockets of the outer garment layer can provide a greater degree of restraint, control, and/or smoothing of the abdominal region and adjacent side regions than attaching the inner abdominal-restraint layer to the side seams of the outer garment layer. The location of the attachment of the inner abdominal-restraint layer to the outer garment layer can be varied to provide the amount of control, restraint, and or smoothing desired by the garment wearer. The location of the attachment of the inner-abdominal restraint layer to the outer garment layer can be anywhere along the inside of the outer garment layer that would allow for the inner abdominal-restraint layer to control, restrain, or smooth undesirable bulges of abdominal fat, and is not limited to the exemplary embodiments of attaching at the side seams of the outer garment layer or lateral seams of the back pockets of the outer garment layer. However, the attachment of lateral edges of the inner abdominal-restraint layer to the outer garment layer is such that the inner abdominal-restraint layer does not wrap all of the way around the garment-wearer's body.

The restraint and control of the garment-wearer's lower abdominal region can be enhanced by attaching the bottom of the inner abdominal-restraint layer (depicted, for example, in FIG. 3) to the outer garment layer. The bottom of the inner abdominal-restraint layer can be attached, for instance, to the inner side of the inseam of the outer garment layer, to the inner side of the crotch seam of the outer garment layer, or to a combination thereof. The bottom of the inner abdominal-restraint layer can be attached to any portion of the outer garment layer that would allow for enhanced control or restraint of the garment-wearer's lower abdominal region, and is not limited to the exemplary embodiments of attaching the bottom to the crotch seam or inseam of the outer garment layer. Further, the bottom of the inner abdominal-restraint layer can be in a variety of shapes. In some embodiments, the bottom is flat. In some embodiments, the bottom is contoured. In some embodiments, the bottom has two leg curves and a flat center portion (i.e., "panty-shaped"). Panty-shaped inner abdominal-restraint layers can, for instance, control and restrain the lower-abdominal region without covering, binding, or cinching the legs.

As noted above, the one-piece abdominal-restraint garments disclosed herein conveniently reduce or eliminate the undesirable muffin-top effect to the garment wearer without the need for putting on separate a shape-wear piece (e.g., pantyhose, control-top underwear, etc.) and outer wear piece (e.g., pants, jeans, skirts, leggings, etc.). Additionally, the convenient one-piece abdominal-restraint garment can be easier for the garment wearer to put on and take off than separate shape-wear pieces and outer-wear pieces (for instance, while dressing for the day or during bathroom breaks during the day). The convenient one-piece abdominal-restraint garment can also be a cooler temperature alternative to separate shape-wear pieces and outer-wear pieces, by retaining less body heat of the garment wearer. Further, the inner abdominal-restraint garment can provide comparable control, restraint, and/or smoothing of undesirable abdominal fat as is possible with a separate shape-wear piece, but without causing undesirable riding up or wedgies (i.e., where an undergarment becomes wedged between the garment-wearer's buttocks). Further, the wrap-around nature of the inner abdominal-restraint layer provides more tummy and/or buttock control than, for instance, an abdominal-restraint garment wherein the inner pockets are attached to the seams. The embodiments described herein can provide more comfort, muffin-top control, and control to the tummy and/or buttocks than other options available in the prior art.

Also disclosed herein are methods of assembling abdominal-restraint garments, comprising attaching a first lateral edge of an inner abdominal-restraint layer to an inner side of an outer garment layer, positioning the inner abdominal-restraint layer over an abdominal portion of the outer garment layer, positioning a top of the inner abdominal-restraint layer such that it is even with a front rise of the outer garment layer or such that it extends above a front rise of the outer garment layer, and attaching a second lateral edge of the inner abdominal-restraint layer to the inner side of the outer garment layer. In some embodiments, the inner abdominal-restraint layer is attached to the outside of the outer garment layer. The inner abdominal-restraint garment can also comprise an inner back shaping piece attached to the outer garment layer, the inner abdominal-restraint layer, or a combination thereof.

In some embodiments, the methods comprise attaching the first lateral edge of the inner abdominal-restraint layer to an inner side of a lateral seam of a first back pocket of a posterior portion of the outer garment layer, and attaching the second lateral edge of the inner abdominal-restraint layer to an inner side of a lateral seam of a second back pocket of the posterior portion of the outer garment layer. In some embodiments, positioning the inner abdominal restraint layer includes elastically extending the inner abdominal restraint layer over the abdominal portion. The methods disclosed herein can further comprise attaching a bottom side of the inner abdominal-restraint layer to an inner side of an inseam of the outer garment layer.

The garments and methods of the appended claims are not limited in scope by the specific garments and methods described herein, which are intended as illustrations of a few aspects of the claims and any garments and methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed.

What is claimed is:

1. An abdominal-restraint garment comprising:

an outer garment layer having a front rise, an inseam, a crotch seam and a posterior portion, the posterior portion of the outer garment layer comprising a first back pocket having a lateral seam and a medial seam and a second back pocket having a lateral seam and a medial seam; and an inner abdominal-restraint layer having a top, a first lateral edge, a second lateral edge, and a bottom side;

wherein the first lateral edge of the inner abdominal-restraint layer is directly attached to the lateral seam of the first back pocket of the posterior portion and the second lateral edge of the inner abdominal-restraint layer is directly attached to the lateral seam of the second back pocket of the posterior portion, wherein the top of the inner abdominal-restraint layer is configured to be even with the front rise of the outer garment layer or extend above the front rise of the outer garment layer, and wherein the bottom side of the inner abdominal-restraint layer is directly attached to the inseam of the outer garment layer, to the crotch seam of the outer garment layer, or to a combination thereof.

2. The abdominal-restraint garment of claim 1, wherein only the first lateral edge, the second lateral edge, and the bottom side of the inner abdominal-restraint layer are attached to the outer garment layer.

3. The abdominal-restraint garment of claim 2, wherein the inner abdominal-restraint layer is configured to extend across a garment-wearer's abdominal region.

4. The abdominal-restraint garment of claim 2, wherein the top of the inner abdominal-restraint layer is configured to extend above the front rise of the outer garment layer by 0.25 inches to 12 inches.

5. The abdominal-restraint garment of claim 2, wherein the abdominal-restraint garment is a pair of pants, jeans, a pair of shorts, a skirt, leggings, or tights.

6. The abdominal-restraint garment of claim 2, wherein the outer garment layer comprises denim, twill, woven fabric, or knit fabric.

7. The abdominal-restraint garment of claim 2, wherein the inner abdominal-restraint layer comprises spandex.

8. The abdominal-restraint garment of claim 2, wherein the inner abdominal-restraint layer comprises an inner fabric layer, an outer fabric layer, and an elastic layer stitched between the inner fabric layer and the outer fabric layer.

9. The abdominal-restraint garment of claim 2, wherein the inner abdominal-restraint layer comprises a single layer of fabric.

10. The abdominal-restraint garment of claim 9, wherein the inner abdominal-restraint layer does not comprise elastic.

11. The abdominal-restraint garment of claim 1, wherein the inner abdominal-restraint layer is attached to the outer garment layer using one of a group consisting of sewing, adhering, zipping, buttoning, snapping, heat sealing, welding, gluing, bonding, laser cutting, and combinations thereof.

12. The abdominal-restraint garment of claim 1, wherein the inner abdominal-restraint layer has a higher elasticity than the outer garment layer.

13. A method of assembling an abdominal-restraint garment, the method comprising directly attaching a first lateral edge of an inner abdominal-restraint layer to a lateral seam of a first back pocket of a posterior portion of an outer garment layer;

positioning the inner abdominal-restraint layer over an abdominal portion of the outer garment layer;

positioning a top of the inner abdominal-restraint layer such that it is even with a front rise of the outer garment layer or such that it extends above a front rise of the outer garment layer;

directly attaching a second lateral edge of the inner abdominal-restraint layer to a lateral seam of a second back pocket of the posterior portion of the outer garment layer; and directly attaching a bottom side of the inner abdominal-restraint layer to an inner side of an inseam of the outer garment layer.

14. The method of claim 13, wherein attaching includes attaching only the first lateral edge, the second lateral edge, and the bottom side of the inner abdominal-restraint layer to the inner side of the outer garment layer.

15. The method of claim 13, wherein attaching includes at least one of sewing, adhering, zipping, buttoning, snapping, heat sealing, welding, gluing, bonding, laser cutting, or combinations thereof.

16. The method of claim 13, wherein attaching comprises configuring the inner abdominal-restraint layer to extend above the front rise of the outer garment layer by 0.25 inches to 12 inches.

17. The method of claim 13, wherein the outer garment layer comprises denim, twill, woven fabric, or knit fabric.

18. The method of claim 13, wherein the inner abdominal-restraint layer comprises spandex.

19. The method of claim 13, wherein the inner abdominal-restraint layer comprises an inner fabric layer, an outer fabric layer, and an elastic layer stitched between the inner fabric layer and the outer fabric layer.

20. The method of claim 13, wherein the inner abdominal-restraint layer comprises a single layer of fabric.

21. The method of claim 20, wherein the inner abdominal-restraint layer does not comprise elastic.

22. The method of claim 13, wherein positioning the inner abdominal restraint layer includes elastically extending the inner abdominal restraint layer over the abdominal portion of the outer garment layer.

* * * * *